US008197278B2

(12) United States Patent
Reusche et al.

(10) Patent No.: US 8,197,278 B2
(45) Date of Patent: Jun. 12, 2012

(54) LOCKING CORD CONNECTOR ASSEMBLY

(75) Inventors: Thomas K. Reusche, Elburn, IL (US); Philip E. Chumbley, Aurora, IL (US); Salvatore Occhipinti, Elburn, IL (US)

(73) Assignee: Allied Precision Industries, Inc., Elburn, IL (US)

( * ) Notice: Subject to any disclaimer, the term of this patent is extended or adjusted under 35 U.S.C. 154(b) by 0 days.

(21) Appl. No.: 12/987,285

(22) Filed: Jan. 10, 2011

(65) Prior Publication Data

US 2011/0171845 A1 Jul. 14, 2011

Related U.S. Application Data

(60) Provisional application No. 61/293,905, filed on Jan. 11, 2010.

(51) Int. Cl.
*H01R 4/38* (2006.01)

(52) U.S. Cl. ..... 439/320

(58) Field of Classification Search ..... 439/367, 439/369, 320

See application file for complete search history.

(56) References Cited

U.S. PATENT DOCUMENTS

| | | | | | |
|---|---|---|---|---|---|
| 2,037,907 | A | * | 4/1936 | Johnson | 439/320 |
| 3,029,408 | A | | 4/1962 | Anderson | |
| 3,281,755 | A | * | 10/1966 | Trager | 439/320 |
| 3,654,588 | A | * | 4/1972 | Ruth | 439/289 |
| 3,663,926 | A | * | 5/1972 | Brandt | 439/321 |
| 3,971,614 | A | * | 7/1976 | Paoli et al. | 439/321 |
| 4,184,732 | A | | 1/1980 | Hudson | |
| 4,291,933 | A | * | 9/1981 | Kakaris | 439/321 |
| 4,484,790 | A | * | 11/1984 | Schildkraut et al. | 439/312 |
| 4,643,505 | A | | 2/1987 | House | |
| 4,664,463 | A | | 5/1987 | Carmo | |
| 4,784,612 | A | | 11/1988 | Ryan | |
| 4,940,424 | A | * | 7/1990 | Odbert | 439/369 |
| 5,082,454 | A | * | 1/1992 | Tonkiss et al. | 439/320 |
| 5,104,335 | A | | 4/1992 | Conley | |
| 5,179,044 | A | | 1/1993 | Muromachi | |
| 5,217,387 | A | | 6/1993 | Hull | |
| 5,505,634 | A | | 4/1996 | Osten | |
| 5,549,482 | A | | 8/1996 | Langlais | |
| 5,772,462 | A | | 6/1998 | Osten | |
| 5,980,278 | A | | 11/1999 | Winkler | |
| 6,878,007 | B1 | * | 4/2005 | Decker | 439/369 |
| 7,001,202 | B2 | * | 2/2006 | Robbins | 439/369 |
| 7,465,182 | B1 | | 12/2008 | McDonald | |
| 7,553,181 | B1 | | 6/2009 | Van Dalinda | |
| 7,833,037 | B2 | * | 11/2010 | Reusche et al. | 439/271 |

* cited by examiner

*Primary Examiner* — Amy Cohen Johnson
*Assistant Examiner* — Vladimir Imas
(74) *Attorney, Agent, or Firm* — Joseph M. Butscher; The Small Patent Law Group, LLC

(57) ABSTRACT

A locking cord connector assembly may include a male housing and a female housing. The male housing defines a male interior chamber configured to house one of a plug or outlet portion of an extension cord. The male housing includes male threads outwardly extending from an outer surface, and at least one tab. The female housing defines a female interior chamber configured to house the other of the plug or outlet portion of an extension cord. The female housing includes female threads inwardly extending from an interior surface. The at least one tab cooperates with a portion of the female housing to provide a ratcheting mechanism configured to maintain a secure connection between the male and female housings.

29 Claims, 3 Drawing Sheets

LOCKING CORD CONNECTOR ASSEMBLY

RELATED APPLICATIONS

The present application relates to and claims priority from U.S. Provisional Application No. 61/293,905, entitled "Locking Electrical Cord Connector," filed Jan. 11, 2010, which is hereby incorporated by reference in its entirety.

FIELD OF THE INVENTION

Embodiments of the present invention generally relate to a system and method of securing an electrical plug to an extension cord, and, more particularly, to a system and method that includes a female housing that is configured to receive and retain a male housing, in which the female housing securely houses a plug or an outlet of an extension cord, while the male housing securely houses the other of the plug or the outlet of an extension cord.

BACKGROUND OF THE INVENTION

Various tools, lighting components, and other such devices are powered through standard electrical outlets. Accordingly, these devices include an electrical cord having a plug at a terminal end. The plug is configured to be connected to an outlet so that electricity may be provided to the device.

Often, extension cords are used so that the device may be positioned at a greater distance from a source of electricity. In some applications, the plug of the device is susceptible to disconnecting from the electrical cord. For example, a power tool such as a circular saw may plug into an outlet of an extension cord, which is, in turn, connected to a wall power outlet. When a user moves the tool, the extension cord may drag across a floor, and snag various objects on the floor. Consequently, the plug of the saw may disconnect from the extension cord.

In some instances, a user may find it helpful to tie the cord of the device to the extension cord proximate the connection, thereby forming a securing knot therebetween. However, in doing so, the total length of the cord and extension is decreased. Additionally, the act of tying the cords together adds another task for the operator.

Also, in many instances, the connection between the plug of the device and the extension cord may allow water to infiltrate therein, which typically leads to shorting out. Such shorts may present potentially dangerous situations that may cause electrical shock or start fires.

In response, numerous securing devices have been used to secure the power cord of a device to an extension cord. Typical securing devices include structural mechanisms for holding two cords together. Other conventional securing devices incorporate a hinged housing that is configured to close around a connection area. Some devices include a gasket or O-ring between connection interfaces to form a water-tight seal therebetween.

However, in many conventional designs, housings may still be susceptible to disconnecting. Accordingly, the connection between a plug within one of the housings and an outlet of an extension cord in another housing may also disconnect.

SUMMARY OF THE INVENTION

Certain embodiments of the present invention provide a locking cord connector assembly that includes a male or first housing, and a female or second housing. The male housing defines a male interior chamber configured to house one of a plug or outlet portion of an extension cord. The male housing includes male threads outwardly extending from an outer surface, and at least one tab.

The female housing defines a female interior chamber configured to house the other of the plug or outlet portion of an extension cord. The female housing includes female threads inwardly extending into the female interior chamber from an interior surface.

The tab cooperates with a portion of the female housing to provide a ratcheting mechanism configured to maintain a secure connection between the male and female housings.

The female housing may include a plurality of teeth inwardly extending from the interior surface. The tab cooperates with the plurality of teeth to provide the ratcheting mechanism.

The tab may be closer to a leading male thread (a thread that first contacts a male thread when the male housing threadably engages the female housing) than a trailing male thread (a thread separated by the leading thread by a space and that contacts a male thread during connection after the leading thread). The tab may include an exposed end over an opening formed in the male housing.

The female housing may include opposing shells configured to pivot with respect to one another between open and closed positions. Similarly, the male housing may include opposing shells configured to pivot with respect to one another between open and closed positions.

A width of valleys or spaces between male threads may be greater than a width of the tab.

The assembly may also include at least one sealing gasket within one or both of the male interior chamber or the female interior chamber.

Figure 1:
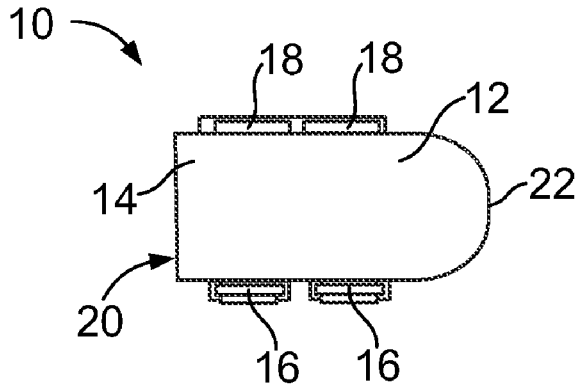
FIG. 1 illustrates a side view of a female securing housing, according to an embodiment of the present invention.

The foregoing summary, as well as the following detailed description of certain embodiments of the present invention, will be better understood when read in conjunction with the appended drawings. For the purpose of illustrating the invention, there are shown in the drawings, certain embodiments. It should be understood, however, that the present invention is not limited to the arrangements and instrumentalities shown in the attached drawings.

DETAILED DESCRIPTION OF THE INVENTION

FIG. 1 illustrates a side view of a female securing housing 10, according to an embodiment of the present invention. The female housing 10 includes an open-ended cylindrical main body 12 formed of opposing shells 14 secured together through hinges 16. The shells 14 pivot with respect to one another about the hinges 16 and securely close together through latching members 18.

The closed female housing 10 defines an interior chamber that a user may gain access to by engaging the latching members 18 and pivoting one shell 14 into an open position with respect to the other shell 14 about the hinges 16. Also, an operator may gain access to the interior chamber through the open end 20.

An electrical plug or outlet portion of an extension cord is configured to be positioned within the interior chamber of the female housing 10. The cord connected to the plug or outlet portion passes through a cord passage 22 that is opposite the open end 20.

The female housing 10 also includes interior threads (not shown in FIG. 1) that extend inwardly from the shells 14 into the interior chamber. The threads are configured to threadably engage reciprocal threads formed on an outer surface of a male housing.

Figure 2:
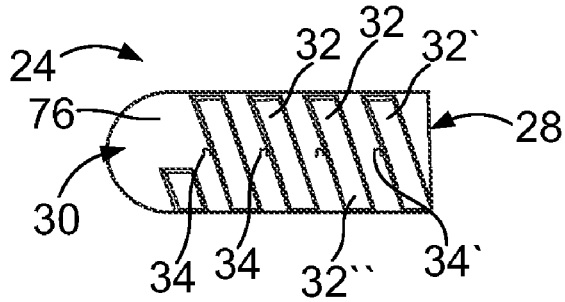
FIG. 2 illustrates a side view of a male securing housing, according to an embodiment of the present invention.

FIG. 2 illustrates a side view of a male securing housing 24, according to an embodiment of the present invention. The male housing 24 is formed of opposing shells 26 that are pivotally secured to one another through at least one living hinge. The shells 26 may snapably secure to one another at edges that are distally located from the living hinges.

The male housing 24 also defines an interior chamber (not shown in FIG. 2) connected to an open end 28. A plug or outlet portion of an extension cord is configured to be positioned within the interior chamber of the male housing 24. An electrical cord connected to the plug or outlet portion passes through the cord passage 30 opposite the open end 28.

As shown in FIG. 2, threads 32 extend outwardly from outer surfaces of the shells 26. The threads 32 are configured to threadably engage threads of the female housing 10 (shown in FIG. 1), as noted above.

Also, tabs 34 extend outwardly from the shells 26. As shown in FIG. 2, the tabs 34 are closer to leading threads that are closer to the open end 28. For example, the tab 34' closest to the open end is adjacent the leading thread 32', but does not abut the trailing thread 32". The remaining tabs 34 are positioned similar with respect to respective leading and trailing threads 32.

Referring to FIGS. 1 and 2, in operation, a user opens the female housing 10 and positions a plug or outlet portion of an extension cord within the interior chamber of the female housing 10. Similarly, the male housing 24 is opened, and the user positions the other of the plug or outlet portion into the interior chamber of the male housing 24. The plug and outlet portion are then connected together. In order to ensure that the plug and outlet portion remain secured to one another, the user then threadably secures the male housing 24 into the female housing 10.

Figure 3:
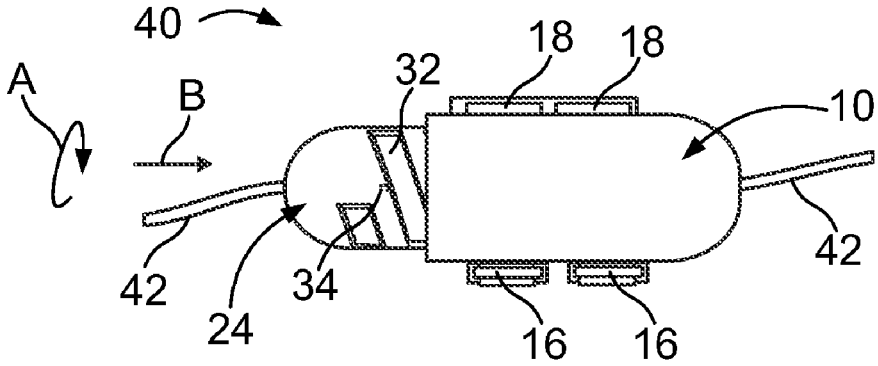
FIG. 3 illustrates a side view of a locking cord connector assembly, according to an embodiment of the present invention.

FIG. 3 illustrates a side view of a locking cord connector assembly 40, according to an embodiment of the present invention. As shown in FIG. 3, as the male housing 24 is rotated within the female housing 10 in the direction of A, the male housing 24 moves into the female housing 10 in the direction of arrow B. The cords 42 of the plug and the outlet portion of an extension cord that are secured within the housing 10 and 24 pass through the housing 10 and 24.

As discussed below with respect to FIGS. 4-8, the tabs 34 of the male housing 24 cooperate with teeth (not shown in FIGS. 1-3) of the female housing 10 to provide a ratcheting mechanism that ensures that the housings 10 and 24 do not disconnect from one another.

Figure 4:
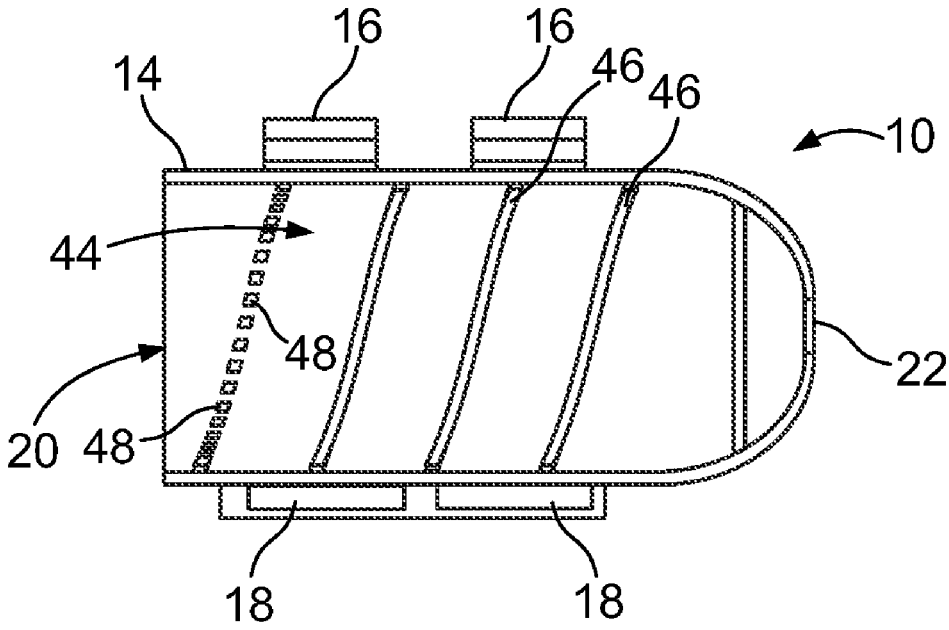
FIG. 4 illustrates a transverse interior view of a female securing housing, according to an embodiment of the present invention.

FIG. 4 illustrates a transverse interior view of the female securing housing 10, according to an embodiment of the present invention. For the sake of simplicity and clarity, only one of the shells 14 is shown.

As noted above, the closed shells 14 define an interior chamber 44. Additionally, threads 46 extend inwardly from the shells 14 into the interior chamber.

A plurality of locking teeth 48 also extend from the shells 14 proximate the open end 20. As shown in FIG. 4, the locking teeth 48 are aligned similarly to the threads 46.

Figure 5:
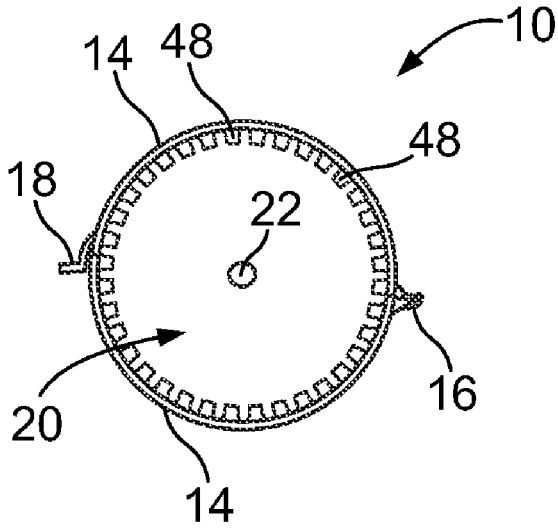
FIG. 5 illustrates an axial interior view of a female securing housing, according to an embodiment of the present invention.

FIG. 5 illustrates an axial interior view of the female securing housing 18, according to an embodiment of the present invention. As shown in FIG. 5, the locking teeth 48 are proximate the open end 20 and are configured to engage each thread 32 of the male housing 24 (shown in FIGS. 2 and 3) before the threads 32 engage the threads 46 of the female housing 10.

Figure 6:
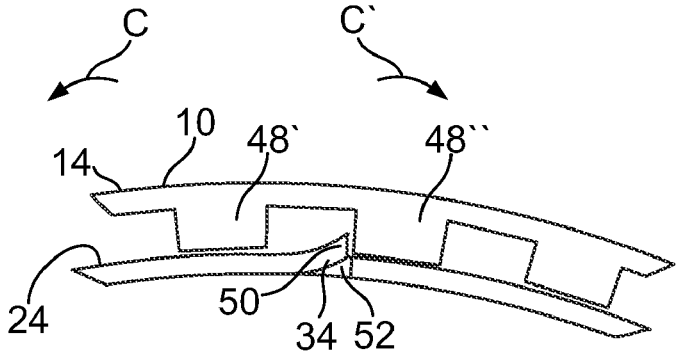
FIG. 6 illustrates a partial axial interior view of locking teeth of a female securing housing engaging a tab of a male securing housing, according to an embodiment of the present invention.

FIG. 6 illustrates a partial axial interior view of the locking teeth 48 of the female securing housing 10 engaging a tab 34 of the male securing housing 24, according to an embodiment of the present invention. The tab 34 includes an exposed end 50 over an opening 52. The exposed end 50 is propped above the outer surface of the male housing 24.

As the male housing 24 moves relative to the female housing 10 in the direction of C (or the female housing 10 moves relative to the male housing 24 in the direction of C'), the tooth 48' slides over the tab 34 and forces the exposed end 50 into the opening 52. As such, the tooth 48' may move over the tab 34.

However, the exposed end 50 then abuts into a lateral surface of the tooth 48", thereby preventing movement in the opposite direction. Accordingly, the teeth 48 and the tabs 34 cooperate to provide a ratcheting mechanism that ensures that the housings 10 and 24 do not inadvertently disconnect from one another.

If a user desires to disconnect the housing 10 and 24 from one another, the user may simply unlatch the shells 14 (shown in FIGS. 1 and 3) of the female housing 10 and pivot the shells 14 open about the hinges 16 (shown in FIGS. 1 and 3).

Figure 7:
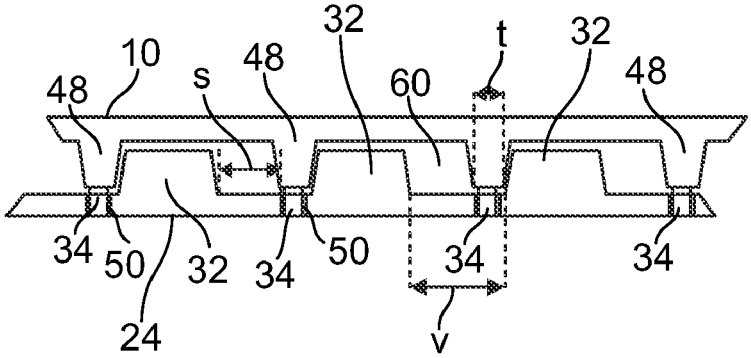
FIG. 7 illustrates a partial side interior view of locking teeth of a female securing housing depressing tabs of a male securing housing, according to an embodiment of the present invention.
Figure 8:
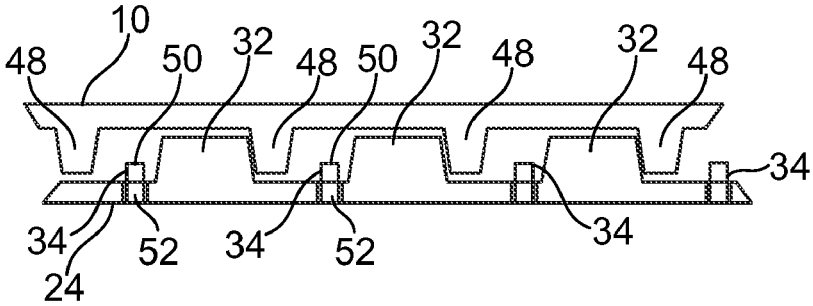
FIG. 8 illustrates a partial side interior view of a female securing housing secured to a male securing housing, according to an embodiment of the present invention.

FIG. 7 illustrates a partial side interior view of the locking teeth 48 of the female securing housing 10 depressing the tabs 34 of the male securing housing 24, according to an embodiment of the present invention. FIG. 8 illustrates a partial side interior view of the female securing housing 10 secured to the male securing housing 24, according to an embodiment of the present invention.

Referring to FIGS. 7 and 8, as the male housing 24 is threaded into the female housing 10, the teeth 48 threadably engage the threads 32 of the male housing 24. Because the tabs 34 are proximate leading threads 32, the teeth 48 are able to immediately engage the tabs 34 and push the exposed ends 50 into the openings 52 after engaging the leading threads 32. Upon continued movement, the teeth 48 move into open areas 60 between threads 32. As the teeth 48 move out of contact with the tabs 34, the exposed ends 50 spring back up, thereby preventing the teeth from retreating back.

In this manner, the teeth 48 and the threads 34 cooperate to provide a ratcheting mechanism that allows the male housing 24 to threadably engage the female housing 10, while at the same time preventing the male housing 24 from dislodging or otherwise disconnecting from the female housing 10. When a user desires to remove the housing 10 and 24 from one another in order to disconnect the secured plug from the secured outlet portion of the extension cord, the user may opt to simply unlatch and open the female housing 10, as noted above.

Optionally, the housings 10 and 24 are configured to be unscrewed so as to disconnect. As shown in FIGS. 7 and 8, the width V of the valleys between the threads 32 of the male housing 24 is such that unoccupied space S between a trailing male thread 32 and a tooth 48 is greater than the width t of the tooth 48. Therefore, by sliding the female housing 10 longitudinally relative to the male housing 24, the female threads and teeth 48 will be shifted to where they will miss the tabs 34 on the male housing 24 as the two housings 10 and 24 are unscrewed with respect to one another. In this manner, the housings 10 and 24 may be unscrewed with respect to one another.

Either or both of the housings 10 and 24 may include gaskets that may be secured to the plug and/or outlet portion to provide a sealing connection. For example, a gasket, such as shown in FIGS. 3 and 6-9 of U.S. Pat. No. 7,833,037, entitled "Cordset Assembly," which is hereby incorporated by reference in its entirety, may be positioned between the plug and the outlet portion in order to provide a sealing, water-tight interface therebetween.

Thus, embodiments of the present invention provide a locking cord connector assembly that includes a ratcheting mechanism that prevents the assembly from disconnecting or otherwise loosening.

While various spatial terms, such as upper, bottom, lower, mid, lateral, horizontal, vertical, and the like may be used to describe embodiments of the present invention, it is understood that such terms are merely used with respect to the orientations shown in the drawings. The orientations may be inverted, rotated, or otherwise changed, such that an upper portion is a lower portion, and vice versa, horizontal becomes vertical, and the like.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments disclosed, but that the invention will include all embodiments falling within the scope of the appended claims.

The invention claimed is:

1. A locking cord connector assembly, comprising:

a male housing defining a male interior chamber configured to house one of a plug or outlet portion of an extension cord, wherein said male housing includes male threads outwardly extending from an outer surface, and at least one tab having at least one resilient exposed end over at least one opening formed through said male housing; and a female housing defining a female interior chamber configured to house the other of the plug or outlet portion of an extension cord, wherein said female housing comprises female threads inwardly extending from an interior surface, wherein said at least one tab cooperates with a portion of said female housing to provide a ratcheting mechanism configured to maintain a secure connection between said male and female housings.

2. The assembly of claim 1, wherein said female housing comprises a plurality of teeth inwardly extending from the interior surface, wherein said at least one tab cooperates with said plurality of teeth to provide the ratcheting mechanism.

3. The assembly of claim 1, wherein said at least one tab is closer to a leading male thread than a trailing male thread.

4. The assembly of claim 1, wherein said female housing further includes opposing shells configured to pivot with respect to one another between open and closed positions.

5. The assembly of claim 1, wherein said male housing further includes opposing shells configured to pivot with respect to one another between open and closed positions.

6. The assembly of claim 1, wherein a width of valleys between male threads is greater than a width of said at least one tab.

7. The assembly of claim 1, further comprising at least one sealing gasket within one or both of said male interior chamber or said female interior chamber.

8. The assembly of claim 1, wherein said ratcheting mechanism allows for rotational movement in a first rotational direction, but prevents rotational movement in a second rotational direction that is opposite the first rotational direction.

9. The assembly of claim 1, wherein said portion of said female housing has a common alignment in relation to said female threads.

10. The assembly of claim 1, wherein said portion of said female housing is configured to engage each of said male threads before each of said male threads engage any of said female threads.

11. A locking cord connector assembly, comprising:

a first housing defining a first interior chamber configured to house one of a plug or outlet portion of an extension cord, wherein said first housing includes first threads outwardly extending from an outer surface, and at least one tab having at least one resilient exposed end over at least one opening formed through said first housing; and a second housing defining a second interior chamber configured to house the other of the plug or outlet portion of an extension cord, wherein said second housing comprises second threads inwardly extending from an interior surface, wherein said at least one tab cooperates with a portion of said second housing to provide a ratcheting mechanism configured to maintain a secure connection between said first and second housings.

12. The assembly of claim 11, wherein said second housing comprises a plurality of teeth inwardly extending from the interior surface, wherein said at least one tab cooperates with said plurality of teeth to provide the ratcheting mechanism.

13. The assembly of claim 11, wherein said at least one tab is closer to a leading first thread than a trailing first thread.

14. The assembly of claim 11, wherein said second housing further includes opposing shells configured to pivot with respect to one another between open and closed positions.

15. The assembly of claim 11, wherein said first housing further includes opposing shells configured to pivot with respect to one another between open and closed positions.

16. The assembly of claim 11, wherein a width of valleys between first threads is greater than a width of said at least one tab.

17. The assembly of claim 11, further comprising at least one sealing gasket within one or both of said first interior chamber or said second interior chamber.

18. The assembly of claim 11, wherein said ratcheting mechanism allows for rotational movement in a first rotational direction, but prevents rotational movement in a second rotational direction that is opposite the first rotational direction.

19. The assembly of claim 11, wherein said portion of said second housing has a common alignment in relation to said second threads.

20. The assembly of claim 11, wherein said portion of said second housing is configured to engage each of said first threads before each of said first threads engage any of said second threads.

21. A locking cord connector assembly, comprising:

a male housing defining a male interior chamber configured to house one of a plug or outlet portion of an extension cord, wherein said male housing includes male threads outwardly extending from an outer surface, and a plurality tabs, wherein each of said plurality of tabs is closer to a leading male thread than a trailing male thread, and wherein each of said plurality of tabs comprises an exposed end over an opening formed in said male housing; and a female housing defining a female interior chamber configured to house the other of the plug or outlet portion of an extension cord, wherein said female housing comprises female threads inwardly extending from an interior surface, and a plurality of teeth inwardly extending from the interior surface, wherein said male housing is configured to securely connect to said female housing through said male threads engaging said female threads, and wherein said plurality of tabs cooperate with said plurality of teeth to provide a ratcheting mechanism configured to maintain a secure connection between said male and female housings.

22. The assembly of claim 21, wherein said female housing further includes opposing female shells configured to pivot with respect to one another between open and closed positions, and wherein said male housing further includes opposing male shells configured to pivot with respect to one another between open and closed positions.

23. The assembly of claim 21, wherein a width of valleys between male threads is greater than a width of said at least one tab.

24. The assembly of claim 21, further comprising at least one sealing gasket within one or both of said male interior chamber or said female interior chamber.

25. The assembly of claim 21, wherein said ratcheting mechanism allows for rotational movement in a first rotational direction, but prevents rotational movement in a second rotational direction that is opposite the first rotational direction.

26. A locking cord connector assembly, comprising:

a male housing defining a male interior chamber configured to house one of a plug or outlet portion of an extension cord, wherein said male housing includes male threads outwardly extending from an outer surface, and at least one tab, wherein said at least one tab is closer to a leading male thread than a trailing male thread; and a female housing defining a female interior chamber configured to house the other of the plug or outlet portion of an extension cord, wherein said female housing comprises female threads inwardly extending from an interior surface, wherein said at least one tab cooperates with a portion of said female housing to provide a ratcheting mechanism configured to maintain a secure connection between said male and female housings.

27. A locking cord connector assembly, comprising:

a male housing defining a male interior chamber configured to house one of a plug or outlet portion of an extension cord, wherein said male housing includes male threads outwardly extending from an outer surface, and at least one tab, wherein a width of valleys between male threads is greater than a width of said at least one tab; and a female housing defining a female interior chamber configured to house the other of the plug or outlet portion of an extension cord, wherein said female housing comprises female threads inwardly extending from an interior surface, wherein said at least one tab cooperates with a portion of said female housing to provide a ratcheting mechanism configured to maintain a secure connection between said male and female housings.

28. A locking cord connector assembly, comprising:

a first housing defining a first interior chamber configured to house one of a plug or outlet portion of an extension cord, wherein said first housing includes first threads outwardly extending from an outer surface, and at least one tab, wherein said at least one tab is closer to a leading first thread than a trailing first thread; and a second housing defining a second interior chamber configured to house the other of the plug or outlet portion of an extension cord, wherein said second housing comprises second threads inwardly extending from an interior surface, wherein said at least one tab cooperates with a portion of said second housing to provide a ratcheting mechanism configured to maintain a secure connection between said first and second housings.

29. A locking cord connector assembly, comprising:

a first housing defining a first interior chamber configured to house one of a plug or outlet portion of an extension cord, wherein said first housing includes first threads outwardly extending from an outer surface, and at least one tab, wherein a width of valleys between first threads is greater than a width of said at least one tab; and a second housing defining a second interior chamber configured to house the other of the plug or outlet portion of an extension cord, wherein said second housing comprises second threads inwardly extending from an interior surface, wherein said at least one tab cooperates with a portion of said second housing to provide a ratcheting mechanism configured to maintain a secure connection between said first and second housings.

* * * * *